US010337836B2

(12) United States Patent
Righi et al.

(10) Patent No.: US 10,337,836 B2
(45) Date of Patent: Jul. 2, 2019

(54) GUIDE FOR FIREARM

(71) Applicant: FABBRICA D'ARMI PIETRO BERETTA S.p.A., Gardone Val Trompia, Brescia (IT)

(72) Inventors: Eugenio Righi, Brescia (IT); Alessandra Flammini, Brescia (IT)

(73) Assignee: FABBRICA D'ARMI PIETRO BERETTA S.p.A., Gardone Val Trompia, Brescia (IT)

( * ) Notice: Subject to any disclaimer, the term of this patent is extended or adjusted under 35 U.S.C. 154(b) by 0 days.

(21) Appl. No.: 16/073,649

(22) PCT Filed: Jan. 25, 2017

(86) PCT No.: PCT/IB2017/050387
§ 371 (c)(1),
(2) Date: Jul. 27, 2018

(87) PCT Pub. No.: WO2017/130113
PCT Pub. Date: Aug. 3, 2017

(65) Prior Publication Data

US 2019/0033038 A1 Jan. 31, 2019

(30) Foreign Application Priority Data

Jan. 27, 2016 (IT) ..... 102016000008328

(51) Int. Cl.
*F41G 11/00* (2006.01)

(52) U.S. Cl.
CPC ..... *F41G 11/003* (2013.01)

(58) Field of Classification Search
CPC ..... F41G 11/003; F41G 1/38; F41G 11/00; F41A 35/00; F41A 3/66; F41C 27/00
(Continued)

(56) References Cited

U.S. PATENT DOCUMENTS 7,029,328 B1 * 4/2006 Mckenzie ..... H01R 13/5221 439/587
7,627,975 B1 * 12/2009 Hines ..... F41G 11/003 42/84

(Continued)

FOREIGN PATENT DOCUMENTS

WO 2010/107324 A1 9/2010

OTHER PUBLICATIONS

International Search Report and Written Opinion of the International Searching Authority for International Patent Application No. PCT/IB2017/050387 dated Apr. 12, 2017, 10 pages.

*Primary Examiner* — Joshua E Freeman
*Assistant Examiner* — Bridget A Cochran
(74) *Attorney, Agent, or Firm* — Merchant & Gould P.C.

(57) ABSTRACT

A guide (1) for a firearm (500) is mechanically and electrically engageable by an accessory device (900). The guide (1) includes a coupling body (2) with two rows of teeth (21, 22) and, between them, an interaction surface (25), identifying interaction modules (250) including a pair of main holes (251) and a secondary hole (252). The guide (1) includes an electronic group (3) having an electronic board (31) and electrical contacts (30) divided into main pairs of electrical contacts (301) housed in the main pairs of holes (251) and secondary pairs of electrical contacts (302) each housed in a respective secondary hole (252). The guide (1) includes a switch group (4), operationally connected to electrical contacts (301, 302) suitable for moving the contacts between an inactive position and an active position upon the action of the accessory group (900) which is thus electrically connected.

18 Claims, 9 Drawing Sheets

(58) Field of Classification Search
USPC ..... 42/90; 89/37.01
See application file for complete search history.

(56) References Cited

U.S. PATENT DOCUMENTS 7,975,419 B2 * 7/2011 Darian ..... F41G 11/003 42/84
8,091,265 B1 * 1/2012 Teetzel ..... F41C 23/16 42/124
8,104,211 B2 * 1/2012 Darian ..... F41C 23/22 362/110
8,151,505 B2 * 4/2012 Thompson ..... F41G 11/003 42/84
9,784,536 B2 * 10/2017 Boswell ..... F41G 11/004
2002/0129536 A1 * 9/2002 Iafrate ..... F41A 33/02 42/134
2004/0219843 A1 * 11/2004 Baker ..... H01R 13/18 439/851
2008/0134562 A1 * 6/2008 Teetzel ..... F41G 1/35 42/146
2009/0044439 A1 * 2/2009 Phillips ..... F41C 23/14 42/72
2010/0180485 A1 * 7/2010 Cabahug ..... F41C 23/04 42/90
2010/0192444 A1 * 8/2010 Cabahug ..... F41G 11/003 42/71.02
2010/0192448 A1 * 8/2010 Darian ..... F41C 23/22 42/84
2010/0218410 A1 * 9/2010 Cabahug ..... F41C 27/00 42/71.01
2010/0279544 A1 * 11/2010 Dodd ..... F41C 23/22 439/533
2011/0030263 A1 * 2/2011 Larsson ..... F41G 11/003 42/90
2011/0061284 A1 * 3/2011 Cabahug ..... F41C 23/22 42/73
2011/0173865 A1 * 7/2011 Compton ..... F41G 11/003 42/84
2011/0214328 A1 * 9/2011 Williams ..... F41G 11/003 42/90
2011/0283585 A1 * 11/2011 Cabahug ..... F41C 23/22 42/73
2012/0131837 A1 * 5/2012 Cabahug ..... F41C 23/22 42/84
2012/0144716 A1 * 6/2012 Cabahug ..... F41C 23/22 42/84
2012/0180363 A1 * 7/2012 Frascati ..... F41G 11/003 42/90
2012/0180364 A1 * 7/2012 Berntsen ..... F41C 23/16 42/90
2012/0192476 A1 * 8/2012 Compton ..... F41G 11/003 42/84
2012/0266514 A1 * 10/2012 Michal ..... F41C 23/16 42/90
2013/0061504 A1 * 3/2013 Malherbe ..... F41G 11/003 42/84
2013/0185978 A1 * 7/2013 Dodd ..... F41G 11/003 42/84
2014/0047754 A1 * 2/2014 Compton ..... F41C 27/00 42/84
2014/0059911 A1 * 3/2014 Oh ..... F41C 23/22 42/16
2015/0020427 A1 * 1/2015 Compton ..... F41C 27/00 42/71.01
2015/0285599 A1 * 10/2015 Downing ..... H04W 4/02 89/1.11
2015/0300786 A1 * 10/2015 Downing ..... H04W 84/12 235/404
2016/0018185 A1 * 1/2016 Makohon ..... F41G 11/001 42/90
2016/0025462 A1 * 1/2016 Downing ..... F41G 11/003 89/1.11
2016/0169610 A1 * 6/2016 Hines ..... F41C 27/00 42/90
2017/0122706 A1 * 5/2017 Masarik ..... F41G 11/003

* cited by examiner

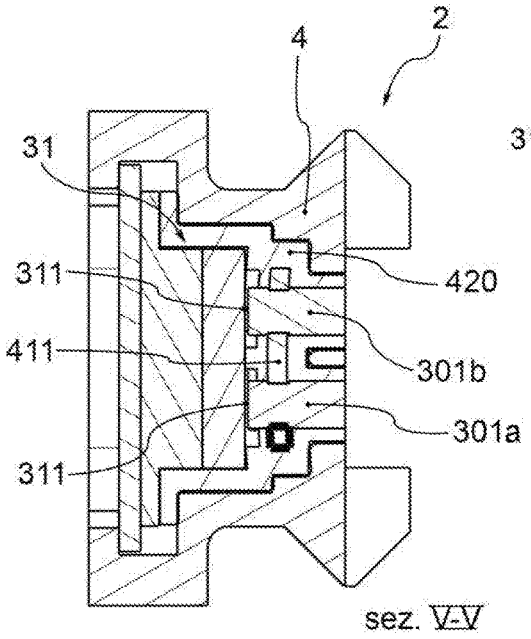
FIG.4a
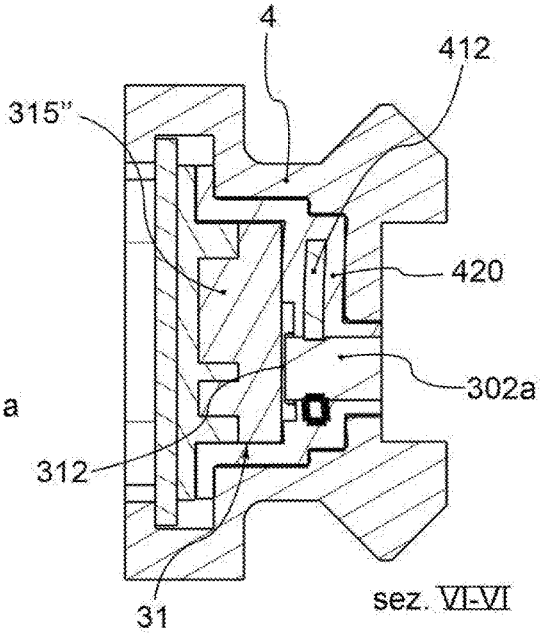
FIG.4b
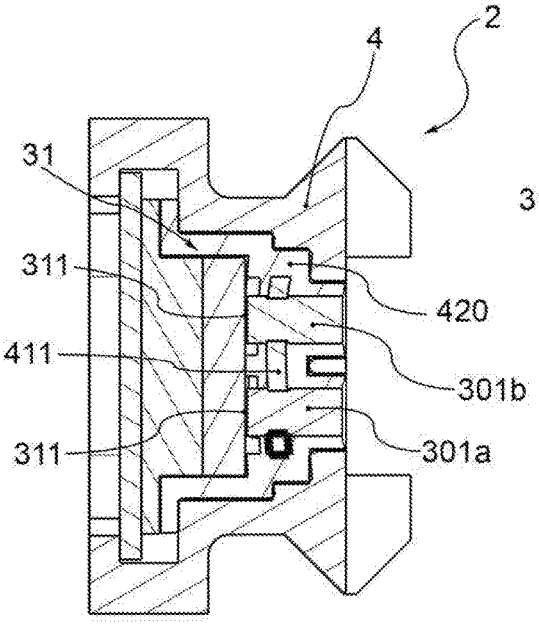
FIG.4a"
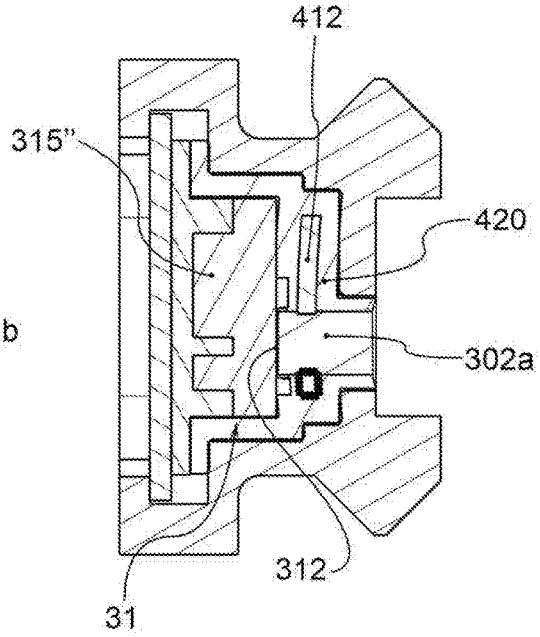
FIG.4b"

GUIDE FOR FIREARM

This application is a National Stage Application of PCT/IB2017/050387, filed 25 Jan. 2017, which claims benefit of Ser. No. 102016000008328, filed 27 Jan. 2016 in Italy, and which applications are incorporated herein by reference. To the extent appropriate, a claim of priority is made to each of the above-disclosed applications.

BACKGROUND OF THE INVENTION

The present invention relates to a guide for a firearm suitable to allow the mechanical and electrical engagement of an accessory device to said firearm. The present invention also refers to the firearm comprising at least a guide, and to a modular firearm system comprising the firearm and at least one accessory device mountable on said firearm.

Typically, such guides are found on firearms of considerable dimensions, such as rifles, sniper rifles, automatic firearms and in some embodiments, even on portable firearms of small size such as handguns or pistols or submachine guns.

Guides for firearms suitable to support a plurality of accessory devices, such as sight accessories, tactical torches, grenade launchers or grips are known of in the art. Such devices are fixable mechanically to the guides, for example by insertion or clamping.

In addition, guides are known of which as well as enabling the support of the firearm by mechanical engagement, are also suitable to assure an electrical engagement to the connected accessory devices. In fact, such guides are fitted with an electrical system having a plurality of contacts on the outside surface, so as to allow the accessory device, mechanically engaged to the guide, to connect through said contacts to the electrical system, for example to use an electric power stored in a battery module connected to the guide or part of the firearm and/or to exchange information.

Given the need to have a harmonised market of accessory devices, there are specific regulations, such as the STANAG AEP-90 (NATO Standard), containing a number of rules for the production of the guides which must therefore comply with predefined geometric requisites and safety standards.

The main problem encountered with the known guides is the presence of electrical and electronic components which are not very versatile, and in some cases not in line with the technological possibilities achievable instead by the accessory devices.

For example, the known guides have a single electric channel engageable by the various accessory devices typically suitable to allow low-speed data transmission between the guide and the device, and possibly between different devices mounted on the guide.

SUMMARY OF THE INVENTION

The purpose of the present invention is to provide a guide for a firearm that solves this problem. In other words, the purpose of the present invention is to provide a guide for a firearm which has the typical requisites of the guides of the prior art, for example being in line with the requirements of regulations on safety and geometric characteristics while providing a more versatile electrical system which is usable by the accessory devices mountable on the guide.

BRIEF DESCRIPTION OF THE DRAWINGS

Moreover, the characteristics and advantages of the guide for a firearm, the firearm and the modular firearm system will be evident from the description given below, made by way of a non-limiting example, with reference to the appended drawings, wherein:

FIGS. 4*a* and 4*b* respectively represent two cross-section views of the guide in FIG. 4 respectively along the cross-section plane V-V and the cross-section plane VI-VI in which the contacts are in the inactive position;

FIGS. 4*a*" and 4*b*" respectively represent two cross-section views of the guide in FIG. 4 respectively along the cross-section plane V-V and the cross-section plane VI-VI in which the contacts are in the active position;

FIGS. 5*a*' and 5*b*' respectively represent two cross-section views of the guide in FIG. 5 respectively along the cross-section plane VII-VII and the cross-section plane VIII-VIII in which the contacts are in the active position;

DETAILED DESCRIPTION OF THE PREFERRED EMBODIMENT

Figure 1:
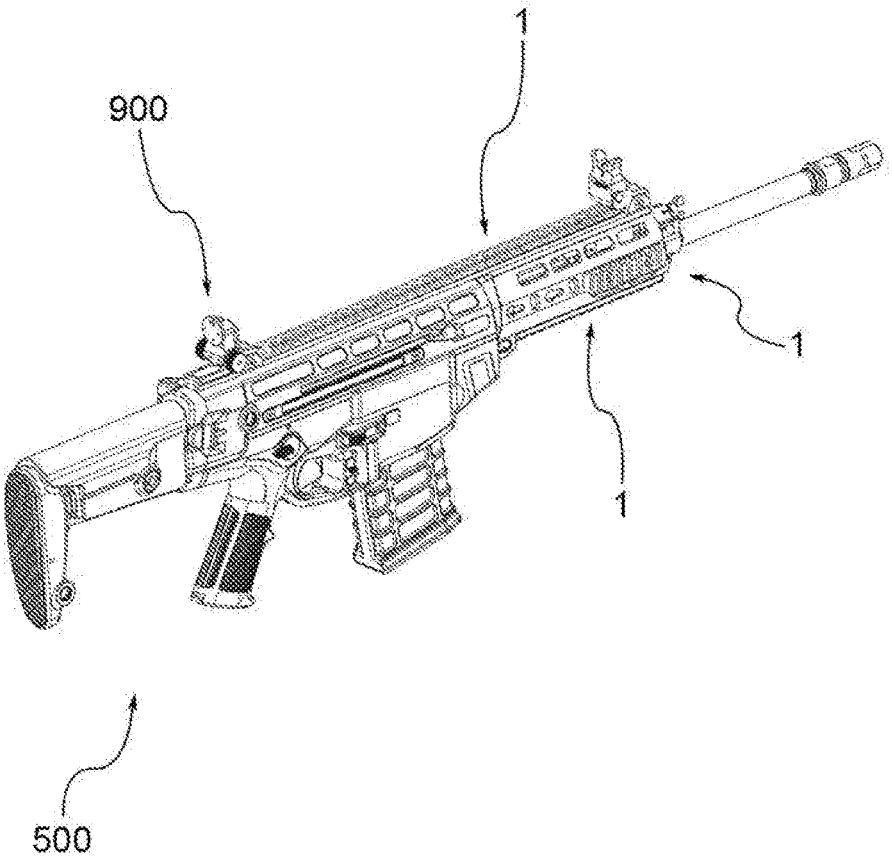
FIG. 1 illustrates a firearm provided with at least a guide for a firearm according to a preferred embodiment and an accessory device mounted thereon.
Figure 2:
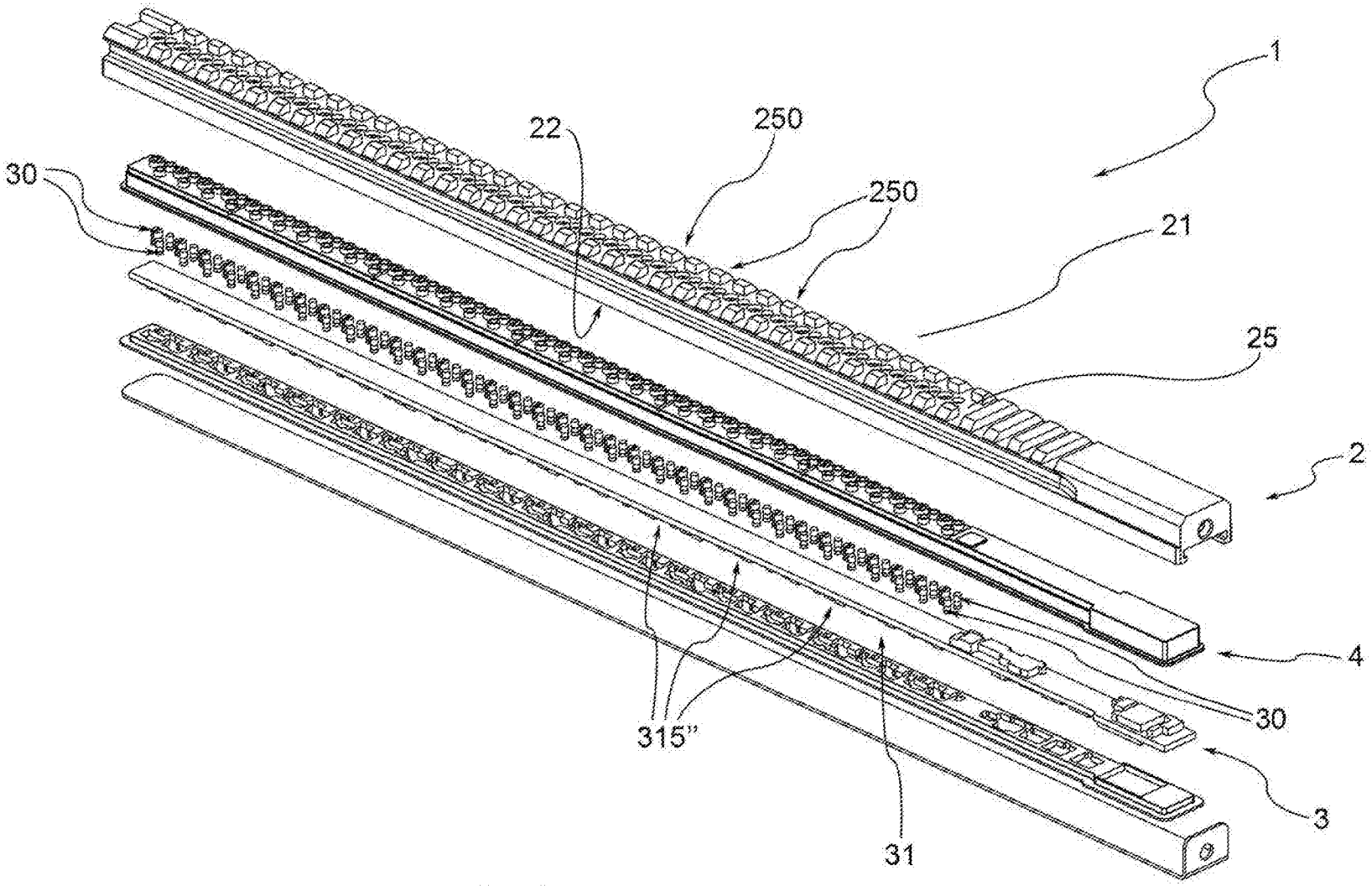
FIGS. 2 and 2' respectively show two perspective views in separate parts of the guide of the present invention according to a preferred embodiment.
Figure 2:
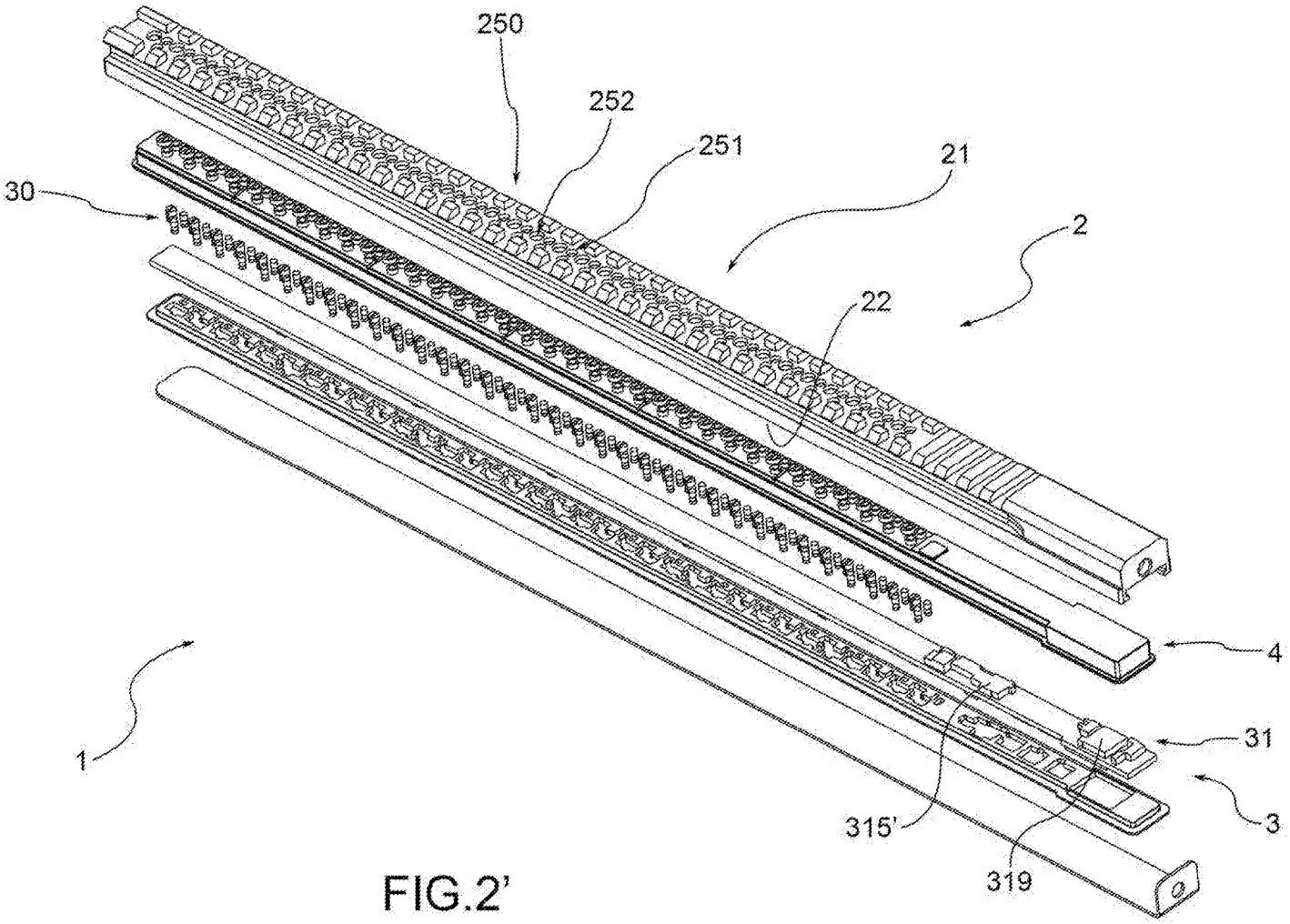
Figure 3A:
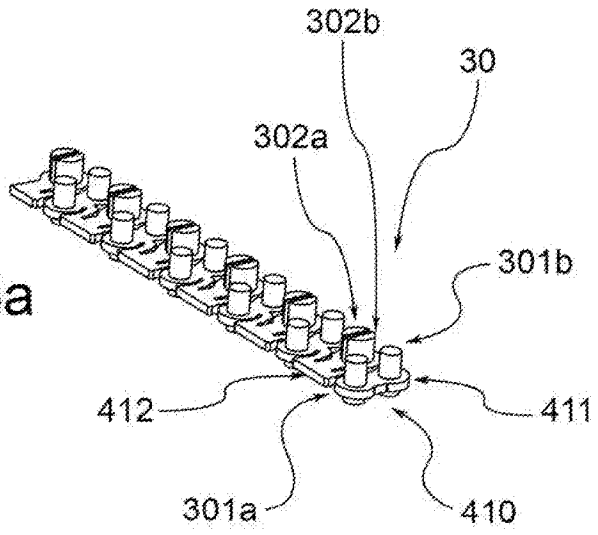
FIGS. 3 and 3*a* respectively show a perspective view and a enlargement of some components of the guide of the present invention, in particular the plurality of electrical contacts and the laminar membrane operatively connected thereto according to a preferred embodiment.
Figure 3:
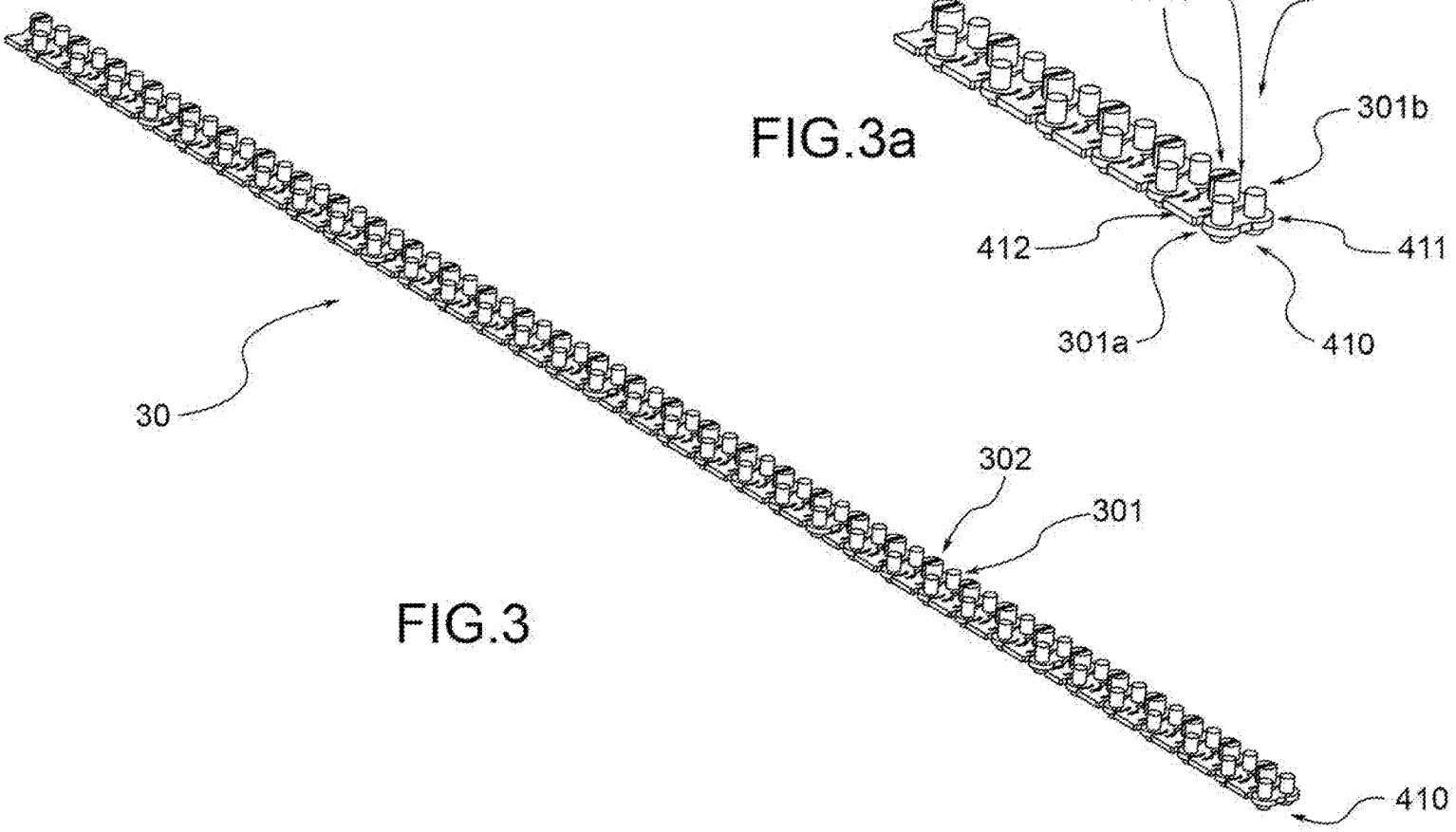
Figure 4:
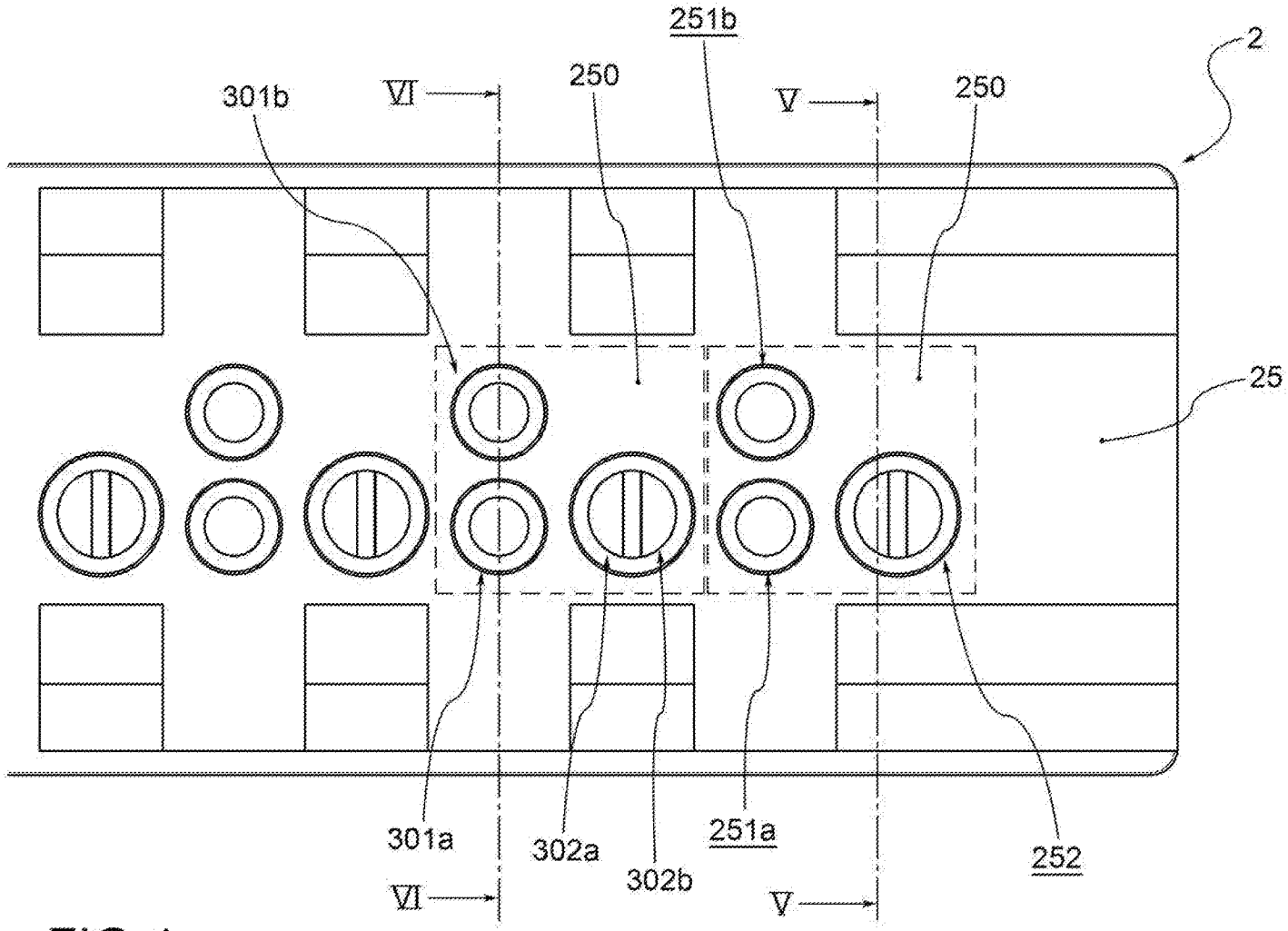
FIGS. 4 and 5 show two views from above of the guide of the present invention.
Figure 5:
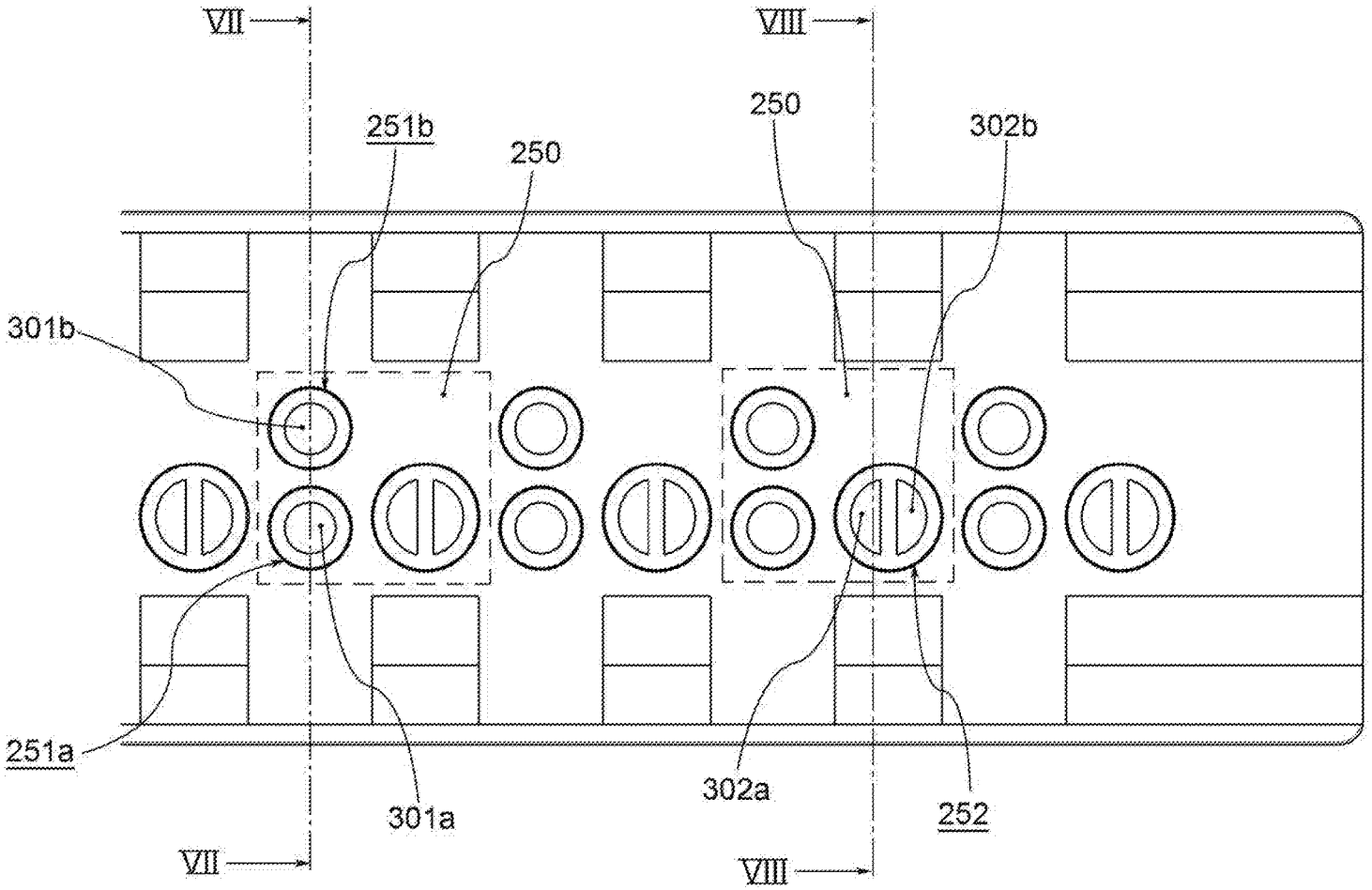
Figure 5A:
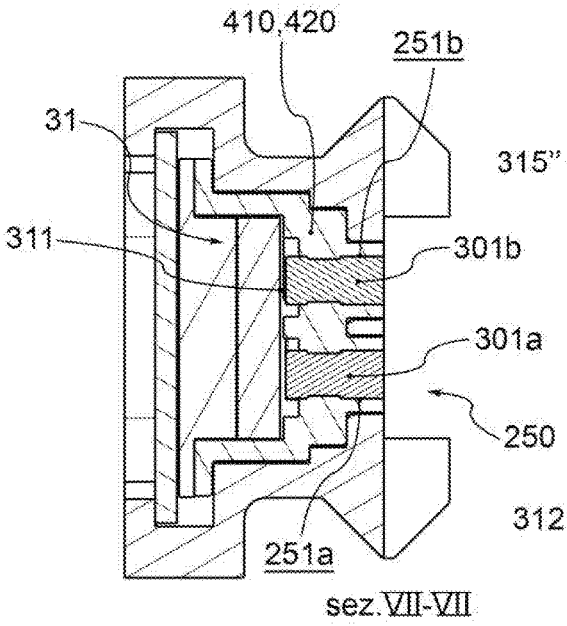
FIGS. 5*a* and 5*b* respectively represent two cross-section views of the guide in FIG. 5 respectively along the cross-section plane VII-VII and the cross-section plane VIII-VIII in which the contacts are in the inactive position.
Figure 5B:
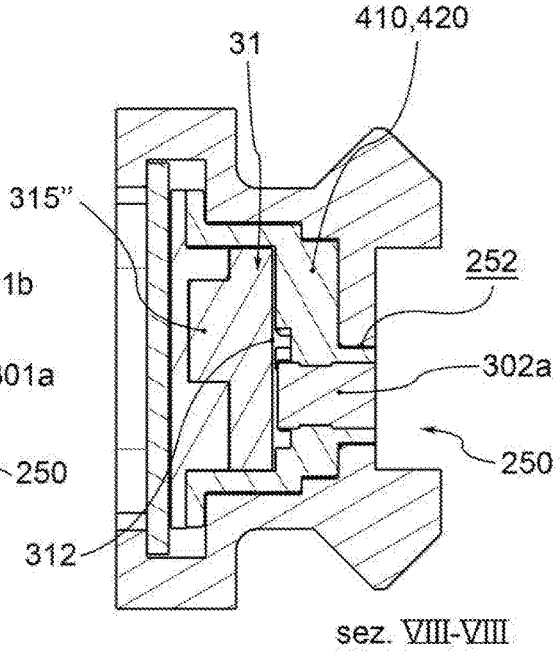
Figure 5A:
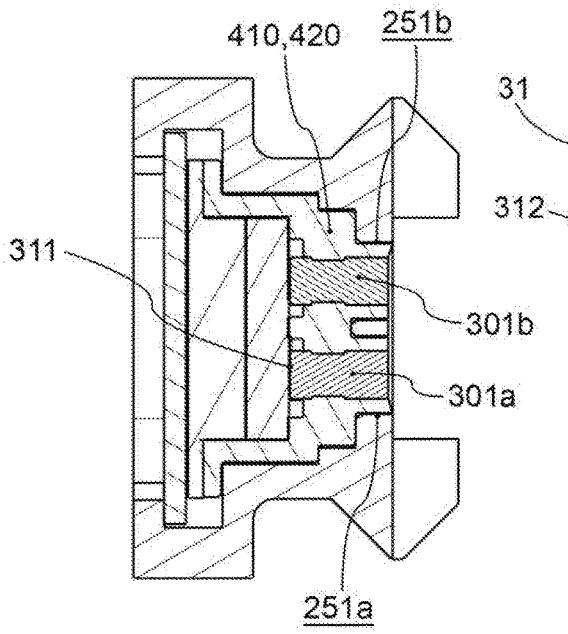
Figure 5B:
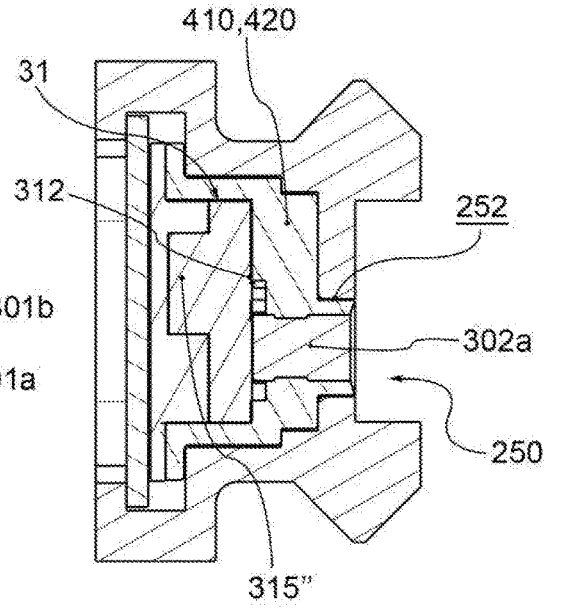

With reference to the appended drawings, reference numeral 1 globally denotes a guide for a firearm mechanically and electrically engageable by an accessory device 900.

In a preferred embodiment, the firearm 500 is of considerable size such as a rifle or sniper rifle or automatic firearm.

In further embodiments, the firearm 500 is small in size, making it portable, such as a handgun or a submachine gun.

According to a preferred embodiment, the accessory device 900 is a sight accessory, a tactical flashlight, a grenade launcher, an accessory grip; preferably, the object of the present invention is not limited to the type of accessory device 900.

Preferably, the accessory device 900 is suitable to engage the guide 1 mechanically, so as to be integral therewith. The present invention is not limited to the characteristics of the accessory device 900 by means of which said mechanical engagement is achieved.

In addition, preferably, the accessory device 900 is also suitable to engage the guide 1 electrically, so as to have an electrical contact and interaction; substantially, as amply described below, the accessory device 900 comprises pins or terminals or electrical contacts specially shaped to ensure the electrical engagement with the guide 1.

According to a preferred embodiment, the guide has a longitudinal extension axis X-X. The guide 1 has a variable length depending on the firearm 500 and depending on its positioning on said firearm 500.

According to a preferred embodiment, the guide 1 complies with the requisites laid down by STANAG AEP-90.

Preferably, the guide 1 comprises a coupling body 2 which extends in length along the axis X-X; preferably, the coupling body 2 comprises the outer structure of the guide 1 which the accessory device 900 is mounted on and mechanically fixed to.

According to a preferred embodiment, the coupling body 2 comprises two rows of teeth 21, 22, placed on opposite sides of the coupling body 2 along the axis X-X; the accessory device 900 is mechanically engageable to said rows of teeth 21, 22 and to the teeth themselves. Preferably, depending on its size, the accessory device 900 is suitable to engage a plurality of teeth. Preferably, the coupling body 2 presents, along the axis X-X, on either side, two recesses, preferably with Picatinny profile, which special portions of the accessory device 900 are housed in.

Preferably, the coupling body 2 covers the interaction surface 25 placed between the two rows of teeth 21, 22, comprising a plurality of interaction modules 250. In other words, in length a plurality of interaction modules 250 are found; preferably, each accessory device 900 is electrically engaged to the guide through at least one interaction module 250; preferably, each accessory device 900 is electrically engaged to the guide through only one interaction module 250.

According to a preferred embodiment, each interaction module 250 comprises a pair of main holes 251*a*, 251*b* and a secondary hole 252.

Preferably, the guide 1 of the present invention fully satisfies the dictates of STANAG AEP-90: the geometrical form and size of the coupling body 2, for example of the teeth (in particular their shape, size and positioning) or for example of the holes (in particular their position and size) fully comply with the provisions of STANAG AEP-90.

According to a preferred embodiment, the guide 1 comprises an electronic unit 3 suitable to allow the electrical engagement with the respective accessory device 900.

According to a preferred embodiment, the electronic unit 3 comprises a plurality of electrical contacts 30, engageable by the specially shaped pins of the accessory device 900. Preferably, the electrical contacts 30 are housed in holes present on the coupling body 2.

According to a preferred embodiment, the electrical contacts 30 comprise:

- a plurality of main pairs of electrical contacts 301*a*, 301*b* housed in the main pairs of holes 251*a*, 251*b;*
- a plurality of secondary pairs of electrical contacts 302*a*, 302*b*, wherein each secondary pair of electrical contacts 302*a*, 302*b* is housed in a respective secondary hole 252.

In other words, the number of main electrical contacts 301*a*, 301*b* is equal to the number of main holes 251*a*, 251*b* (each main hole 251*a*, 251*b* contains a main electrical contact 251*a*, 251*b*) and the number of secondary electrical contacts is twice the number of secondary holes 252 (each secondary hole 252 comprises a pair of secondary contacts 302*a*, 302*b*).

Preferably, each pair of electrical contacts is a dipole, in other words within the same pair of contacts there is a positive contact and a negative contact.

According to a preferred embodiment, the electronic unit 3 further comprises an electronic board 31 which comprises a primary system 311 engageable by the main electrical contacts 301*a*, 301*b* and a secondary system 312 engageable by the secondary electrical contacts 302*a*, 302*b*. In other words, the plurality of electrical contacts 301*a*, 301*b* is electrically connected by the primary system 311, while the plurality of secondary electrical contacts 302*a*, 302*b* is electrically connected by the secondary system 312.

According to a preferred embodiment, the primary system 311 and secondary system 312 transmit electrical signals at different speeds, for example the primary system 311 is suitable to transmit a signal at low transmission speed, and the secondary system 312 is suitable to transmit a signal at high transmission speed.

According to a preferred embodiment, the electronic unit 3 allows a two-way exchange of electric power between the accessory device 900 and guide 1.

In other words, through the engagement between the pins of the accessory device 900 and the electrical contacts 30, an exchange of electric power through the primary system 311 and/or the secondary system 312 is possible between the guide 1 and the accessory device 900.

According to a preferred embodiment, the electronic group 3 is suitable to connect in parallel through the primary system 311 and/or the secondary system 312 a plurality of accessory devices 900 mechanically and electrically engaged to the guide 1. Preferably, the primary system 311 and the secondary system 312 extend in length along the axis X-X.

According to a preferred embodiment, the electronic board 31 comprises a management apparatus 315 operatively connected to the primary system 311 and/or to the secondary system 312 suitable to test, control and manage the electrical signals. Preferably, the management apparatus 315 is in fact suitable to analyse the electrical signal, for example it is suitable to analyse predefined physical characteristics of the electrical signal. As a function of such analysis, the management apparatus 315 then controls the two-way exchange of information and/or power between the accessory device 900 or accessory devices 900 and the guide 1.

Preferably, the management apparatus 315 comprises a main unit 315' suitable to manage the primary system 311 and/or the secondary system 312 in their entirety.

According to a preferred embodiment, the main unit 315' further comprises a memory in which a plurality of information accessible from the accessory device 900 is storable. Such memory is designed to contain specific information about the firearm, such as the serial number, or predefined operating conditions of the firearm, such as the time or date, such as to add to the information exchanged between the guide 1 and the accessory device 900.

Preferably, the management apparatus 315 is suitable to allow communication of the guide with the accessory device 900 via a standard language of the manufacturer of the accessory devices 900 or via a proprietary language.

According to a preferred embodiment, the management apparatus 315 comprises a plurality of local units 315", in which each local unit 315" is suitable to manage a predefined portion of primary system 311 and/or a predefined portion of secondary system 312. Preferably, for each module 250 or for two adjacent modules 250 the management apparatus 315 comprises a local unit 315" which is suitable to manage a predefined portion of the primary system 311 and/or of the secondary system 312 specific to the respective module.

According to a preferred embodiment, each local unit 315" is suitable to act as a safety element, for example as a "fail safe" switch: if the management apparatus 315 verifies specific input current values of the respective accessory device 900 and considers them abnormal or non-compliant with the predefined threshold values, it orders the shutdown of the respective local unit 315" thus interrupting the passage of current.

According to a preferred embodiment, the electronic board 31 comprises a battery 319 operatively connected to the primary system 311 and/or to the secondary system 312. Via said systems, the guide allows an exchange of electric power from the battery 319 to at least an accessory device 900, preferably in a two-way manner. Preferably, the battery 319 is not required: in fact the guide 1 is suitable to receive power from the accessory device 900 and to work powered by said accessory.

According to a preferred embodiment, the guide 1 of the present invention further comprises a switch group 4 operatively connected to the electrical contacts 301*a*, 301*b*, 302*a*, 302*b* to move them between an inactive position, in which they are detached from the respective system 311, 312, and an active position, in which they are in contact with the respective system 311, 312. Preferably, the switching from one position to the other takes place upon the action of the accessory group 900 which is electrically connected to the guide 1. In particular, such action of the accessory group 900 is performed by its pins, specially shaped to engage the respective electrical contacts of the guide performing a thrust action.

Figure 6:
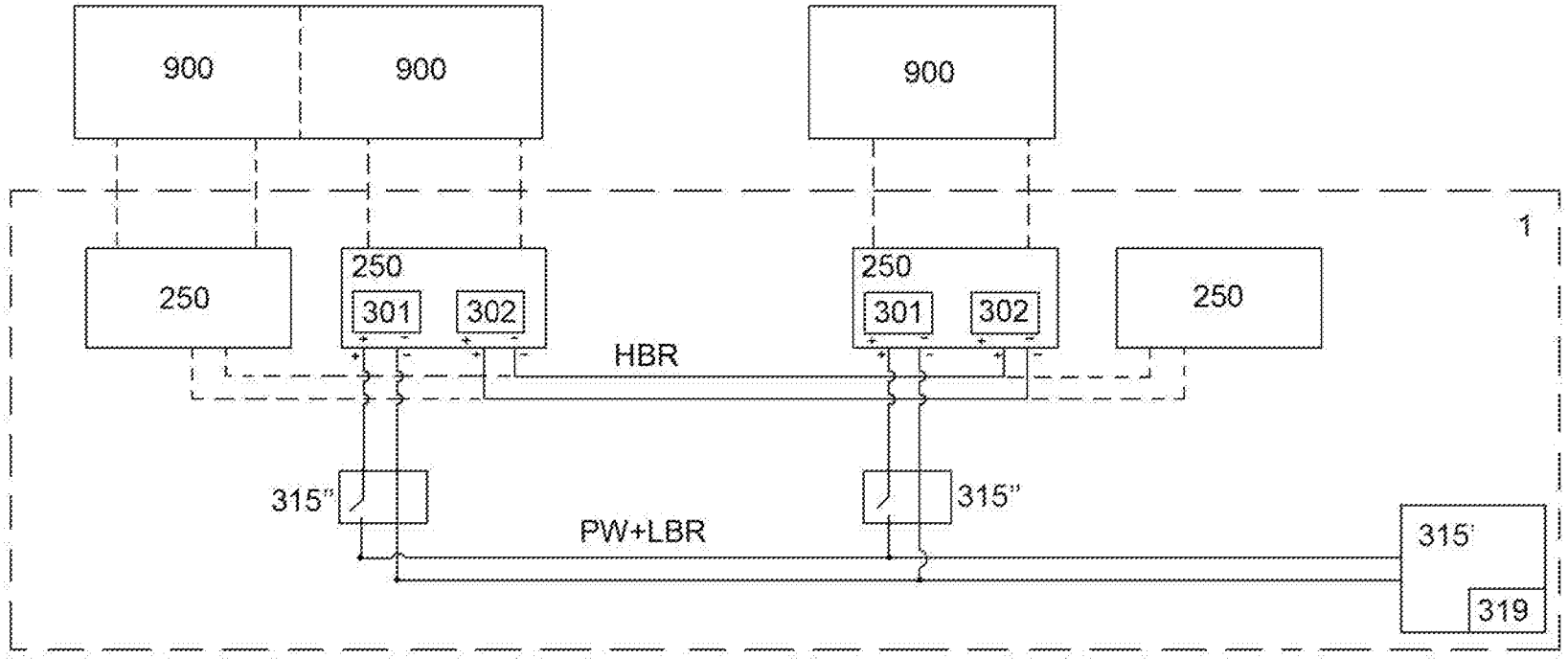
FIG. 6 shows a schematic block diagram of the guide and its engagement with an accessory device, according to a preferred embodiment.

According to a preferred embodiment, such as that shown schematically in FIG. 6, the management apparatus 315 is operatively connected and is suitable to manage only the primary system 311.

In other words, according to such embodiment, the secondary system 312 is suitable to place in electrical communication, in parallel, a number of accessory devices 900, without managing the electricity exchanged: the management of the electricity via the secondary system 312 is in fact entrusted to the accessory devices 900 themselves. Preferably, the secondary system 312 is suitable to transmit electrical information at high speed, such as a speed of 10 Mb/s, while it is not suitable to allow the transit of high power supplies.

In this embodiment, in addition, the primary system 311 is, in turn, suitable to place in electrical communication the guide 1 with at least an accessory device 900 and/or a plurality of accessory devices 900 in parallel with each other: through the primary system 311 this exchange of electrical current is assessed, controlled and managed by the management apparatus 315, preferably via the main unit 315 and the local units 315". Preferably through the primary system 311 electrical signals are transmitted at low transmission speeds, such as speed of 19.2 Kbps. Preferably the two-way exchange of electric power is guaranteed and controlled via the primary system 311.

In a preferred embodiment, the switch group 4 is housed in the coupling body 2.

Preferably, the switch group 4 is suitable to keep the electrical contacts 30 released from the respective electric circuits, at the same time it is suitable to be moved upon action of the accessory device 900 to allow such contact and close the circuit.

In a preferred embodiment, the switch group 4 comprises an actuation member 41 elastically yielding to the action of the electric contact 30 in turn engaged by the accessory device 900.

According to a preferred embodiment, the actuation member 41 comprises a membrane element 410 operatively connected to each pair of contacts.

Preferably, the membrane element 410 extends in length along the axis X-X.

According to a preferred embodiment, the membrane element 410 is made in one piece.

Preferably, the membrane element 410 is a laminar element. In a preferred embodiment, the laminar element is in one piece, while in other embodiments the laminar element is instead made in a modular manner, consisting of several pieces joined together.

According to a preferred embodiment, the membrane element 410 comprises a plurality of main elastic portions 411 respectively operatively connected to each main pair of electrical contacts 301*a*, 301*b* and a plurality of secondary elastic portions 412 respectively operatively connected to each secondary pair of electrical contacts 302*a*, 302*b*. Each of said elastic portions is therefore suitable to change locally upon pressure of the accessory device to create the desired contact, closing the circuit.

According to a preferred embodiment, the switch group 4 comprises a sealing element 420 suitable to seal tight the inside of the coupling body 2, wherein the electrical contacts 30 are embedded therein.

In a preferred embodiment, the membrane element 410 and the sealing element 420 are a single component.

Preferably, the membrane element 410, regardless of its embodiment, in turn satisfies the requirements of STANAG AEP-90. In fact, the transition from the inactive to the active position takes place upon the action of the accessory device 900 between 12N and 18N.

The present invention also relates to a firearm 500 comprising at least one guide 1 having the aforementioned characteristics.

Preferably, the firearm 500 comprises a plurality of guides 1 having the characteristics described above.

Preferably, said guides 1 are electrically connected to each other. In a preferred embodiment, the firearm 500 presents around its barrel a plurality of guides 1, for example 4. Preferably, the firearm 500 comprises a ring element suitable for electrically connecting said plurality of guides 1. Preferably, the ring element is suitable to operate outside the guides 1 attaching itself to a predetermined interaction module 250 of each guide 1, engaging the respective electrical contacts of each of said modules 250.

In an embodiment variant, only one of the plurality of guides 1 in the firearm 500 comprises the control unit 315', suitable to manage all the guides in their totality.

The present invention also relates to a modular firearm system comprising a firearm 500, having the characteristics described above, and at least an accessory device 900 mountable on said firearm 500.

Innovatively, the support guide of the present invention addresses the problems typical of the prior art, providing a guide suitable to ensure a versatile use of the accessory devices mechanically and electrically fixed to it.

Advantageously, the support guide is integrally engageable mechanically by an accessory device, so that the latter is not subject to any accidental detachments.

In addition, advantageously, the support guide is electrically engageable by an accessory device, either through the primary system or through the secondary system, by means of the main electrical contacts and/or secondary electrical contacts pressed by the pins of the accessory device specially shaped for such type of engagement.

An additional advantageous aspect is that the support guide allows the electrical connection both with signals at low transmission speed preferably through the primary system, and with signals at high transmission speed, preferably through the secondary system: in fact, advantageously, the accessory devices are suitable to transmit, for example to another accessory device engaged by the guide, data of considerable size such as video streaming.

Yet a further advantageous aspect of the guide consists of the fact that between the guide and accessory devices a two-way exchange of power is possible. Advantageously, an accessory device is suitable to power the guide and/or an additional accessory device mounted on it. Advantageously, an accessory device mounted on a first guide is also suitable to power a second guide comprised in the firearm in a preferred embodiment.

Advantageously, the guide manages the electrical signals crossing the electrical systems, so as to assess their signals and manage the communication between guide and accessory device; advantageously, in the case of abnormal or non-conforming electrical signals, for example due to higher electric currents than a predetermined threshold value, or for example related to communication protocols other than those of the main unit, the local units are made to turn off, keeping the guide safe. Advantageously, the guide, at least in its primary system, operates safely with respect to the possibility of short circuits occurring in the electrical engagement with an accessory device or the possibility that an accessory device not recognized by the guide is connected, such as one operating in an unrecognised data language.

Moreover, according to a further advantageous aspect, the guide is active only in the module engaged by a respective accessory device, while the modules not engaged by an electrical device are not electrically active, being kept in the inactive position by the switch group.

Yet a further advantageous aspect is that the guide is weather resistant, having electrical contacts in a corrosion-resistant material and a switch group comprising a sealing element.

Advantageously, the guide satisfies the geometrical and safety requisites of STANAG AEP-90.

In addition, advantageously, accessory devices normally available on the market are mountable on the guide, in turn satisfying the requisites of STANAG AEP-90.

An additional advantageous aspect lies in the fact that the guide is configured to communicate with the accessory devices via an ad-hoc language, or by using the language of the devices.

Yet a further advantageous aspect is also related to the fact that the guide is suitable to add its own information, for example related to the firearm on which it is mounted, to the information of the accessory device.

Advantageously, the guide is externally configurable interfacing with it through the electrical contacts without requiring additional access points.

In addition, advantageously, the guide comprises an extremely limited number of components. Advantageously, the guide does not have intrusive dimensions on the structure and geometry of the firearm.

Lastly, advantageously, the guide does not necessarily have a battery, being, in fact, powered by the accessory device itself preferably via the primary system.

Advantageously, in the embodiment shown in FIG. 6, the guide engaged with one or more accessory devices is suitable to manage both electrical power signals and electrical communication signals at high and low transmission speeds: in fact, through the management apparatus operating through the primary system both an electrical power signal and an electrical communication signal is managed, the latter, preferably at low transmission speed given the presence of possible noise due to the electric power; while, through the secondary system, the guide 1 is suitable to allow an electrical communication exchange at high speeds.

It is clear that a person skilled in the art may make modifications to the guide and to the firearm comprising it described above so as to satisfy contingent requirements while remaining within the sphere of protection of the following claims.

The invention claimed is:

1. A guide for firearms which extends along an axis, mechanically and electrically engageable by an accessory device, wherein the guide comprises: a coupling body extending in length along the axis, comprising: two rows of teeth, placed on opposite sides of the coupling body along the axis, mechanically engageable by the accessory device; an interaction surface, located between the two rows of teeth, comprising a plurality of interaction modules, wherein each module comprises a pair of main holes and a secondary hole; an electronic group comprising: a plurality of electric contacts comprising: a plurality of main pairs of electrical contacts respectively housed in the main pairs of holes; a plurality of secondary pairs of electrical contacts, wherein each pair is housed in the respective secondary hole; an electronic board which extends in length along the axis comprising a primary system engageable by the main electrical contacts and a secondary system engageable by the secondary electrical contacts; a switch group, housed in the coupling body, operationally connected to the electrical contacts to move the electrical contacts between an inactive position where the electrical contacts are detached from the respective system and an active position in which, upon the action of the accessory device, the electrical contacts are in contact with the respective system.

2. The guide according to claim 1, wherein the electronic group permits a two-way exchange of electricity between the accessory device and the guide.

3. The guide according to claim 2, wherein the primary system permits a two-way exchange of electricity between the accessory device and the guide.

4. The guide according to claim 1, wherein the primary system and the secondary system to transmit electrical signals at different speeds, wherein the primary system transmits a signal at low transmission speed, and wherein the secondary system transmits a signal at high transmission speed.

5. The guide according to claim 1, wherein the electronic guide is suitable to connect in parallel through the primary system and/or the secondary system a plurality of accessory devices mechanically and electrically engaged to the guide.

6. The guide according to claim 1, wherein the electronic board comprises a management apparatus operatively connected to the primary system and/or to the secondary system to test, control and manage any the electrical signals passing through said systems.

7. The guide according to claim 6, wherein the management apparatus comprises a main unit suitable to manage the primary system and/or the secondary system in entirety.

8. The guide according to claim 7, wherein the main unit further comprises a memory in which a plurality of information accessible from the accessory device is storable.

9. The guide according to claim 6, wherein the management apparatus comprises a plurality of local units, in which each local unit manages a respective portion of the primary system and/or of the secondary system relative to a corresponding module.

10. The guide according to claim 6, wherein the management apparatus is operatively connected and manages only the primary system.

11. The guide according to claim 1, wherein the electronic board comprises a battery operatively connected to the primary system and to the secondary system.

12. The guide according to claim 1, wherein the switch group comprises an actuation member elastically yielding to the action of the electric contact in a configuration in which the electrical contact is engaged by the accessory device.

13. The guide according to claim 1, wherein an actuation member comprises a membrane element which extends in length along the axis, and comprises a plurality of main elastic portions respectively, that are operatively connected to each main pair of electrical contacts, and a plurality of secondary elastic portions respectively, that are operatively connected to each secondary pair of electrical contacts.

14. The guide according to claim 1, wherein the switch group comprises a sealing element sealing tight an inside of the coupling body, and wherein the electrical contacts are embedded inside said sealing element.

15. The guide according to claim 1, wherein the coupling body has dimensions and a geometric shape dictated by NATO standard STANAG AEP-90.

16. A firearm comprising the support guide according to claim 1.

17. A firearm comprising: a plurality of support guides according to the guide of claim 1 further comprising: a ring element to electrically connect said plurality of support guides.

18. A modular firearm system comprising a firearm according to claim 16, and having at least one accessory device mechanically and electrically engageable on at least one guide comprised in the firearm.

* * * * *